US006910862B2

(12) United States Patent
Horng et al.

(10) Patent No.: US 6,910,862 B2
(45) Date of Patent: Jun. 28, 2005

(54) AIRFLOW GUIDING STRUCTURE FOR A HEAT-DISSIPATING FAN

(75) Inventors: Alex Horng, Kaohsiung (TW); Yin-Rong Hong, Kaohsiung (TW); Ching-Sheng Hong, Kaohsiung (TW)

(73) Assignee: Sunonwealth Electric Machine Industry Co., Ltd., Kaohsiung (TW)

( * ) Notice: Subject to any disclaimer, the term of this patent is extended or adjusted under 35 U.S.C. 154(b) by 0 days.

(21) Appl. No.: 10/642,636

(22) Filed: Aug. 19, 2003

(65) Prior Publication Data

US 2005/0042089 A1 Feb. 24, 2005

(51) Int. Cl.[7] ..... F04D 29/54
(52) U.S. Cl. ..... 415/211.2; 415/221
(58) Field of Search ..... 415/208.2, 211.1, 415/211.2, 220, 221

(56) References Cited

U.S. PATENT DOCUMENTS

| | | | | |
|---|---|---|---|---|
| 2,653,757 | A * | 9/1953 | Segalman | 415/148 |
| 6,017,191 | A * | 1/2000 | Harmsen | 416/247 R |
| 6,398,492 | B1 * | 6/2002 | Cho et al. | 415/91 |
| 6,601,546 | B1 * | 8/2003 | Mohr et al. | 123/41.49 |
| 6,722,418 | B2 * | 4/2004 | Zhang | 165/80.3 |

* cited by examiner

*Primary Examiner*—Ninh H. Nguyen
(74) *Attorney, Agent, or Firm*—Bacon & Thomas, PLLC

(57) ABSTRACT

A heat-dissipating fan includes a casing having an air outlet, a base mounted in the air outlet, an impeller being mounted on the base and having a plurality of blades, a plurality of ribs each extending between the base and the casing along a radial direction of the base, and at least one guiding ring fixedly mounted to the ribs. The guiding ring has an axial length that is longer than a width of the guiding ring in the radial direction. The guiding ring guides and divides airflow passing through the air outlet when the impeller is turning.

16 Claims, 10 Drawing Sheets

AIRFLOW GUIDING STRUCTURE FOR A HEAT-DISSIPATING FAN

BACKGROUND OF THE INVENTION

1. Field of the Invention

The present invention relates to an airflow guiding structure for a heat-dissipating fan.

2. Description of Related Art

FIG. 1 of the drawings illustrates a typical heat-dissipating fan including a casing 10, an air inlet 11 defined in a side of the casing 10, an air outlet 12 defined in the other side of the casing 10, a base 13, and a plurality of ribs 14. The base 13 is secured by the ribs 14 in the air outlet 12. A stator (not shown) and an impeller (not shown) are mounted to the base 13. When the impeller turns, air is sucked into the casing 10 via the air inlet 11 and exits the casing 10 via the air outlet 12 to dissipate heat from an object such as a fin or a central processing unit.

Although the above-mentioned heat-dissipating fan provides a certain heat-dissipating effect, the heat-dissipating operation can only be performed on an object directly below the air outlet 12, as the airflow can only flow along an axial direction of the casing 10. In a case that the object is not located directly below the air outlet 12, the airflow cannot flow through the object in a uniform manner, resulting in non-uniform heat dissipation and poor heat-dissipating effect. On the other hand, since the object is generally mounted in a limited space such as in a notebook type computer (or a laptop computer) in a position not directly below the base 13 or outside the area of air outlet, the heat-dissipating effect is adversely affected. The heat-dissipating effect is also adversely affected if the object is too large to be completely within an area directly below the heat-dissipating fan. Further, turbulence tends to occur when the airflow is passing through the ribs 14. Noise is thus generated while having a lower heat-dissipating effect.

OBJECTS OF THE INVENTION

An object of the present invention is to provide an air-guiding structure for a heat-dissipating fan that includes at least one guiding ring in an air outlet of the heat-dissipating fan for concentrating and guiding airflow, increasing wind pressure, reducing wind noise, and improving the overall heat-dissipating efficiency.

Another object of the present invention is to provide an air-guiding structure for a heat-dissipating fan that includes at least one guiding ring in an air outlet of the heat-dissipating fan. The guiding ring extends radially inward or outward relative to a longitudinal direction of the casing, thereby concentrating and guiding airflow, increasing wind pressure, reducing wind noise, and improving the overall heat-dissipating efficiency.

A further object of the present invention is to provide an air-guiding structure for a heat-dissipating fan that includes at least one guiding ring in an air outlet of the heat-dissipating fan. An inclination angle of the guiding ring is selected to guide airflow to a desired area for concentrated heat dissipation or for enlarging the heat-dissipating area, thereby improving the overall heat-dissipating efficiency and making the assembly and design of the heat-dissipating fan more flexible.

SUMMARY OF THE INVENTION

In accordance with a first aspect of the invention, a heat-dissipating fan includes a casing having an air outlet, a base mounted in the air outlet, an impeller being mounted on the base and having a plurality of blades, a plurality of ribs each extending between the base and the casing along a radial direction of the base, and at least one guiding ring fixedly mounted to the ribs. The guiding ring has an axial length that is longer than a width of the guiding ring in the radial direction. The guiding ring guides and divides airflow passing through the air outlet when the impeller is turning.

In an embodiment of the invention, the guiding ring extends in a direction parallel to a longitudinal direction of the casing. In another embodiment of the invention, the guiding ring extends downward and radially outward. In a further embodiment of the invention, the guiding ring extends downward and radially inward.

In still another embodiment of the invention, the guiding ring includes an annular inner face extending downward and radially inward and an annular outer face extending downward and radially outward. The guiding ring has a triangular section, with the annular inner face and the annular outer face meeting at a common annular ridge.

The ribs may incline along an air-driving direction of the blades of the impeller. Each rib has two rib sections respectively on two sides of the guiding ring, the rib sections having different inclining angles. The guiding ring may include a rounded guiding portion in a top thereof adjacent to an air inlet side of the casing.

In accordance with a second aspect of the invention, a heat-dissipating fan includes a casing having an air outlet, a base mounted in the air outlet, an impeller being mounted on the base and having a plurality of blades, a plurality of ribs each extending between the base and the casing along a radial direction of the base, a first guiding ring fixedly mounted to the ribs and located between the base and the casing, and a second guiding ring fixedly mounted to the ribs and located between the first guiding ring and the casing. The first guiding ring and the second guiding ring guide and divide airflow passing through the air outlet when the impeller is turning.

Preferably, each of the first guiding ring and the second guiding ring has an axial length and a width in the radial direction, with the axial length being longer than the width.

In an embodiment of the invention, the first guiding ring extends downward and radially outward and the second guiding ring extends downward and radially inward. In another embodiment of the invention, the first guiding ring extends downward and radially inward and the second guiding ring extends downward and radially outward.

In a further embodiment of the invention, the first guiding ring includes an annular inner face extending downward and radially inward and an annular outer face extending downward and radially outward, and the second guiding ring includes an annular inner face extending downward and radially inward and an annular outer face extending downward and radially outward. Each of the first guiding ring and the second guiding ring has a triangular section, with the annular inner face and the annular outer face of the first guiding ring meeting at a common annular ridge, and with the annular inner face and the annular outer face of the second guiding ring meeting at another common annular ridge.

Other objects, advantages and novel features of this invention will become more apparent from the following detailed description when taken in conjunction with the accompanying drawings.

DETAILED DESCRIPTION OF THE PREFERRED EMBODIMENTS

Figure 1:
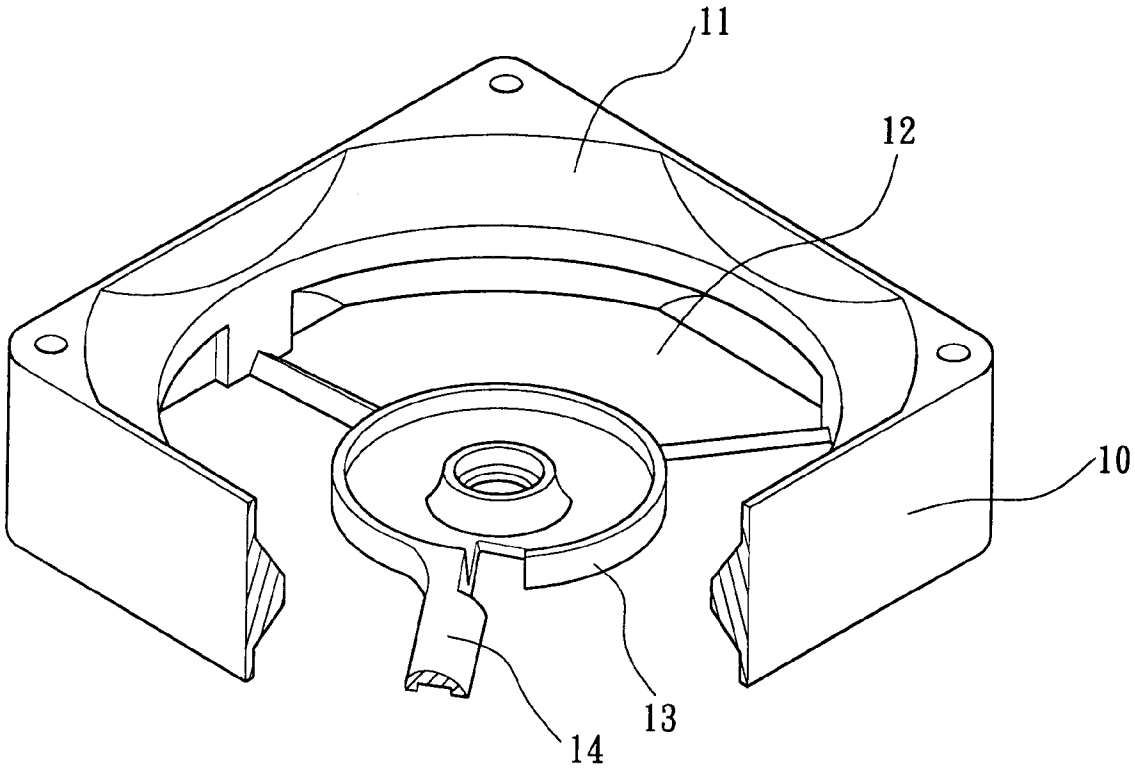
FIG. 1 PRIOR ART
FIG. 1 is a perspective view, partly cutaway, of a conventional heat-dissipating fan.

Preferred embodiments of the present invention are now to be described hereinafter in detail, in which the same reference numerals are used in the preferred embodiments for the same parts as those in the prior art to avoid redundant description.

Figure 2:
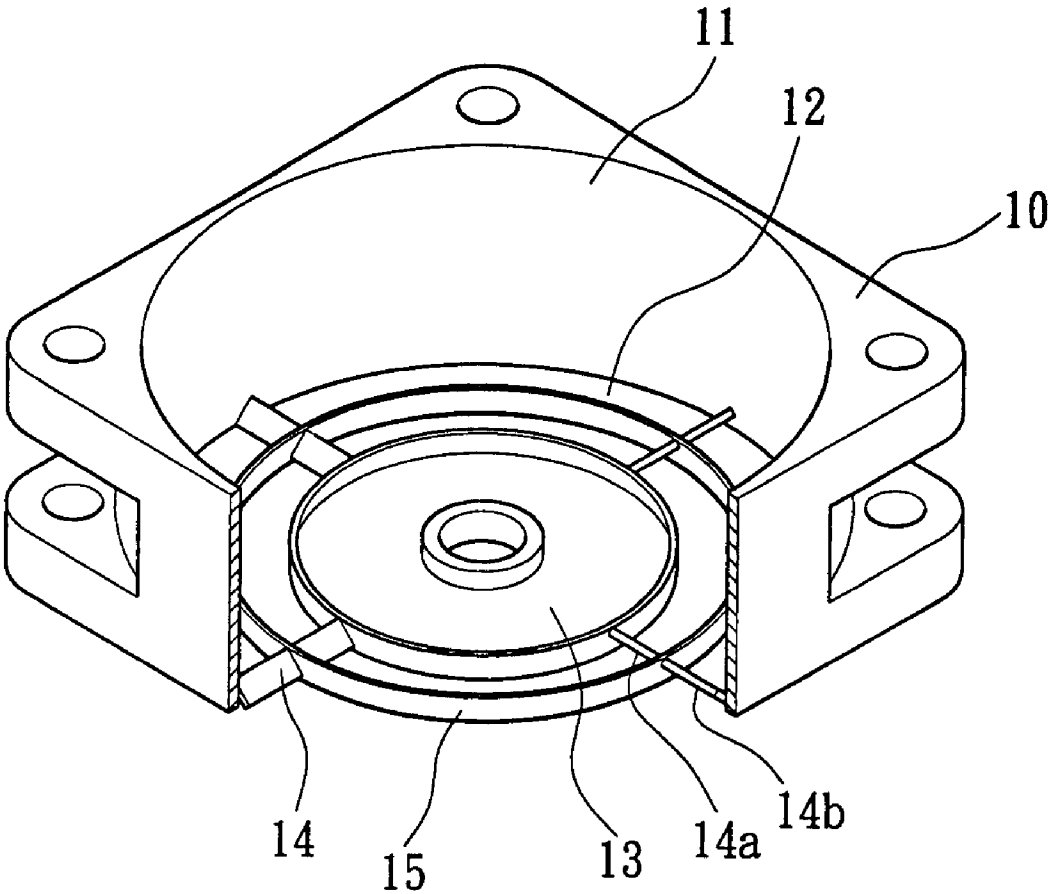
FIG. 2 is a perspective view, partly cutaway, of a heat-dissipating fan with a first embodiment of an air guiding structure in accordance with the present invention.
Figure 3:
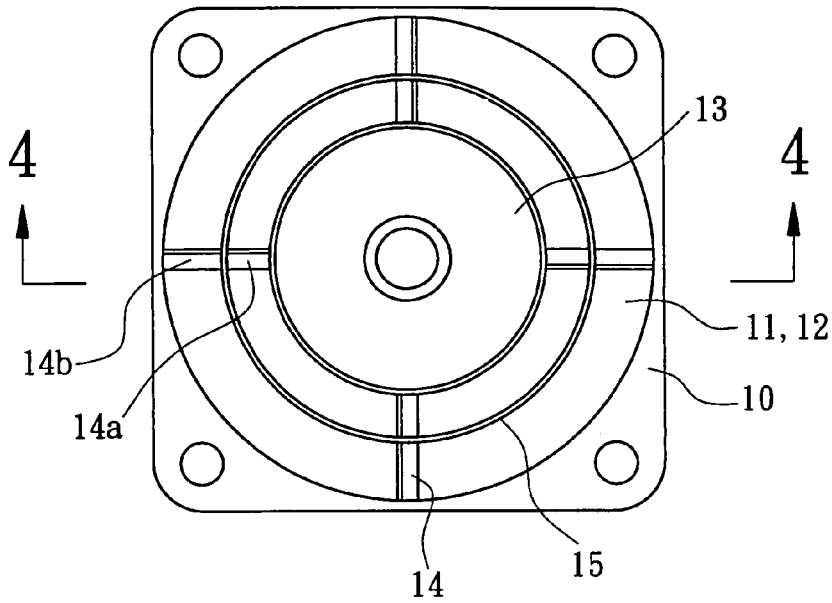
FIG. 3 is a top view of the heat-dissipating fan in FIG. 2.
Figure 4:
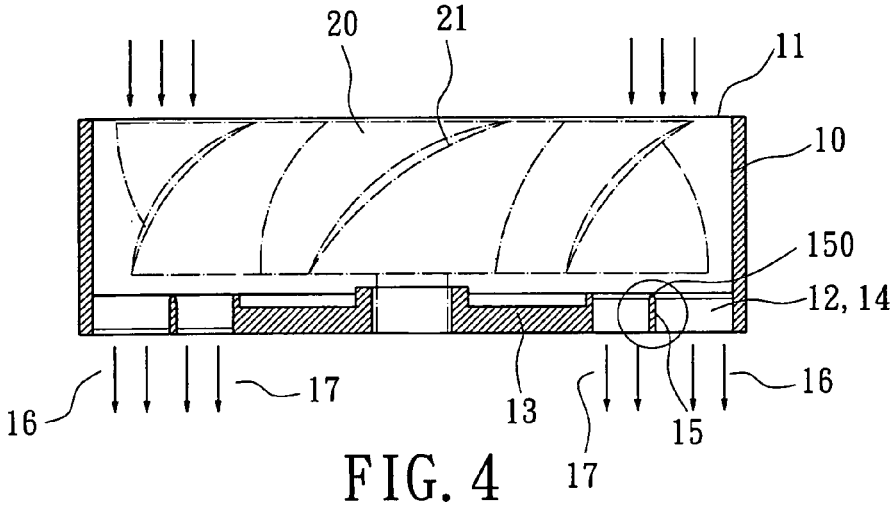
FIG. 4 is a sectional view taken along line 4—4 in FIG. 3.
Figure 4A:
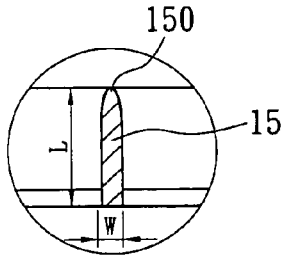
FIG. 4A is an enlarged view of a circled portion of FIG. 4.

Referring to FIGS. 2, 3, 4, and 4A, a heat-dissipating fan with a first embodiment of an air guiding structure in accordance with the present invention includes a casing 10, an air inlet 11, an air outlet 12, a base 13, a plurality of ribs 14, and a guiding ring 15. The casing 10 may be made of plastics or metal, with the air inlet 11 and the air outlet 12 being respectively defined in two opposite sides of the casing 10. The base 13 is located in the air outlet 12, and an impeller 20 (FIG. 4) is mounted on the base 13. The ribs 14 extend between the base 13 and the casing 10 along a radial direction of the base 13. The guiding ring 15 is located between the base 13 and the casing 10 (FIG. 4) and extends along a longitudinal direction of the casing 10. Further, the guiding ring 15 extends across the ribs 14 and is fixedly mounted to the ribs 14. As illustrated in FIG. 4A, the guiding ring 15 has an axial length L that is preferably longer than a width W of the guiding ring 15 in the radial direction. Further, the guiding ring 15 has a rounded guiding portion 150 in a top end thereof adjacent to the air inlet side of the casing 10, thereby reducing turbulence. Further, the ribs 14 may incline along an air-driving direction of a plurality of blades 21 of the impeller 20.

Still referring to FIG. 4, when the impeller turns 20, the blades 21 of the impeller 20 introduce airflow into the casing 10 via the air inlet 11 and expel the airflow via the air outlet 12, thereby dissipating heat from an object such as a fin or central processing unit (not shown). When the airflow passes through the guiding ring 15 and the ribs 14, the guiding ring 15 divides the airflow into an inner portion 17 that is guided toward a center of the air outlet 12 and an outer portion 16 that is guided flows through an outer section of the air outlet 12 between the ribs 14 and the casing 10. Thus, the heat-dissipating fan provides a reliable concentrated heat-dissipating effect within a specific area. Also, the heat-dissipating fan is suitable for use in a limited space (e.g., in a notebook type computer or laptop computer), as the airflow can be guided to an object in a position not directly below the air outlet 12. Thus, the guiding ring 15 provides an air-guiding effect.

Further, as illustrated in FIGS. 2 and 3, the ribs 14 also provide an air-guiding effect when the ribs 14 incline along an air-driving direction of a plurality of blades 21 of the impeller 20. Meanwhile, the rib sections 14*a* and 14*b* of the ribs 14 respectively on two sides of the guiding ring 15 may have different inclination angles according to need.

Figure 5:
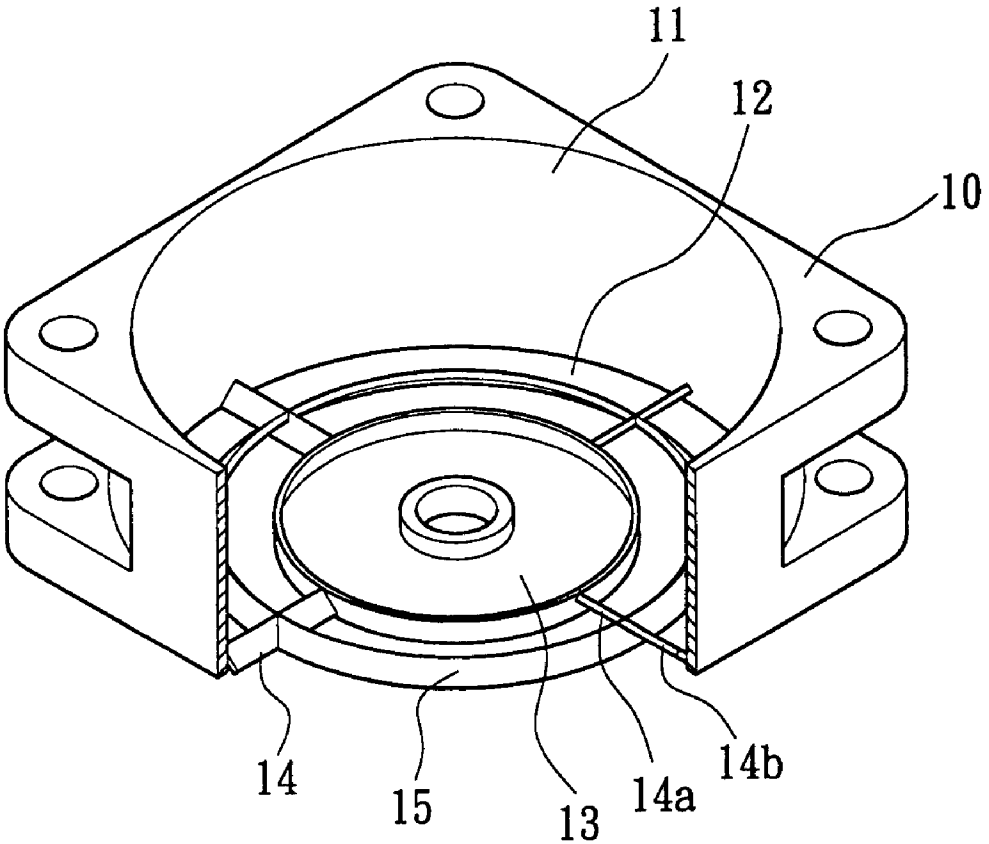
FIG. 5 is a perspective view, partly cutaway, of a heat-dissipating fan with a second embodiment of the air guiding structure in accordance with the present invention.
Figure 6:
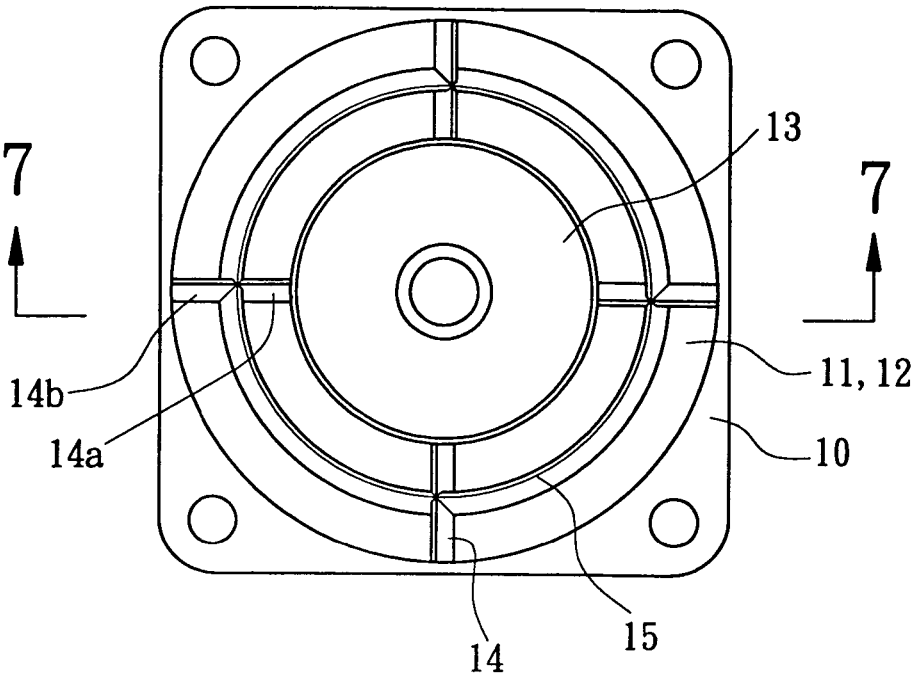
FIG. 6 is a top view of the heat-dissipating fan in FIG. 5.
Figure 7:
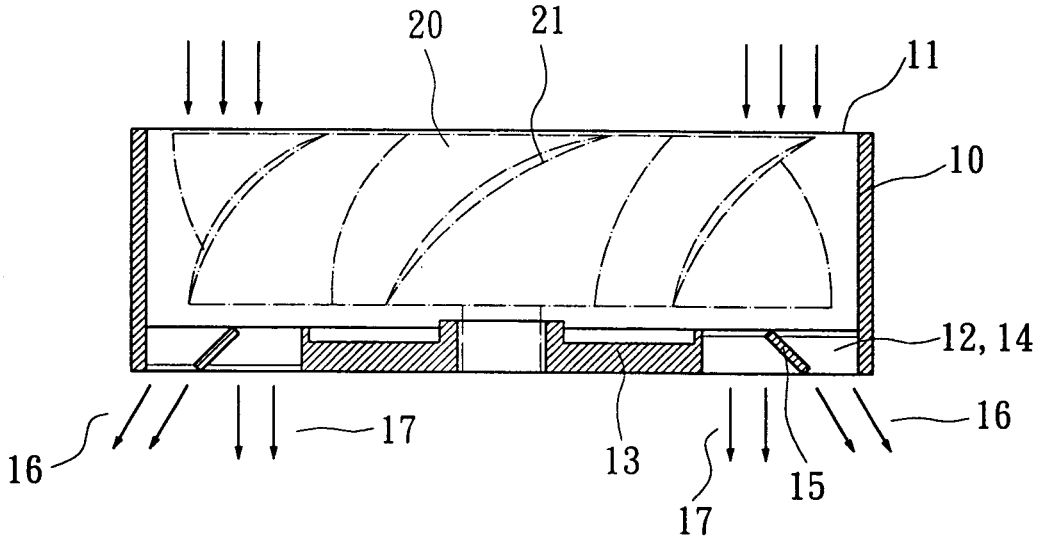
FIG. 7 is a sectional view taken along line 7—7 in FIG. 6.

FIGS. 5 through 7 illustrate a heat-dissipating fan with a second embodiment of the air guiding structure in accordance with the present invention. In this embodiment, the guiding ring 15 extends downwardly (downstream) and radially outward away from the base 13, best shown in FIG. 7.

Still referring to FIG. 7, when the impeller turns 20, the blades 21 of the impeller 20 introduce airflow into the casing 10 via the air inlet 11 and expel the airflow via the air outlet 12, thereby dissipating heat from an object such as a fin or central processing unit (not shown). When the airflow passes through the guiding ring 15 and the ribs 14, the guiding ring 15 that extends downwardly and radially outward divides the airflow into an inner portion 17 that is guided downward and an outer portion 16 that is guided downward and outward to an area outside the air outlet 12. Thus, more area can be cooled by the heat-dissipating fan. Also, the heat-dissipating fan is suitable for use in a limited space (e.g., in a notebook type computer or laptop computer), as the airflow can be guided to an object in a position not directly below the air outlet 12 or to an object having a relatively large size for more uniform heat dissipation. Thus, the guiding ring 15 provides an air-guiding effect.

Further, as illustrated in FIG. 7, following the inclining direction of the guiding ring 15, the wind pressure is increased by the guiding ring 15. Further, since the wind pressure of the outer portion 16 of the airflow exiting the air outlet 12 is increased due to downward and radially outward inclination of the guiding ring 15, the inner portion 17 of the airflow tends to flow radially inward, providing a concentration effect for the airflow for dissipating heat. The air flowing efficiency is thus improved.

Further, as illustrated in FIG. 5, the ribs 14 also provide an air-guiding effect when the ribs 14 incline along an air-driving direction of a plurality of blades 21 of the impeller 20. Meanwhile, the rib sections 14*a* and 14*b* of the ribs 14 respectively on two sides of the guiding ring 15 may have different inclination angles according to need.

Figure 8:
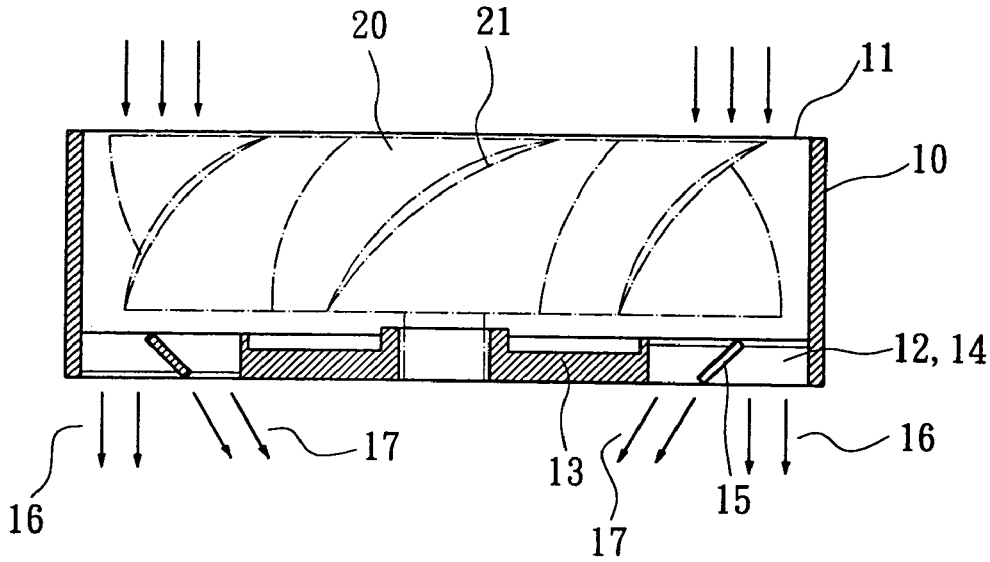
FIG. 8 is a sectional view similar to FIG. 7, illustrating a heat-dissipating fan with a third embodiment of the air guiding structure in accordance with the present invention.

FIG. 8 illustrates a heat-dissipating fan with a third embodiment of the air guiding structure in accordance with the present invention. In this embodiment, the guiding ring 15 extends downward (downstream) and radially inward. Thus, an inner portion 17 of airflow is guided toward an object directly below the base 12, providing improved heat-dissipating efficiency. Following the inclining direction of the guiding ring 15, the wind pressure is increased by the guiding ring 15. Further, since the wind pressure of the inner portion 17 of the airflow exiting the air outlet 12 is increased due to downward and radially inward inclination of the guiding ring 15, the outer portion 16 of the airflow tends to flow radially inward, providing a concentration effect for the airflow for dissipating heat.

Figure 9:
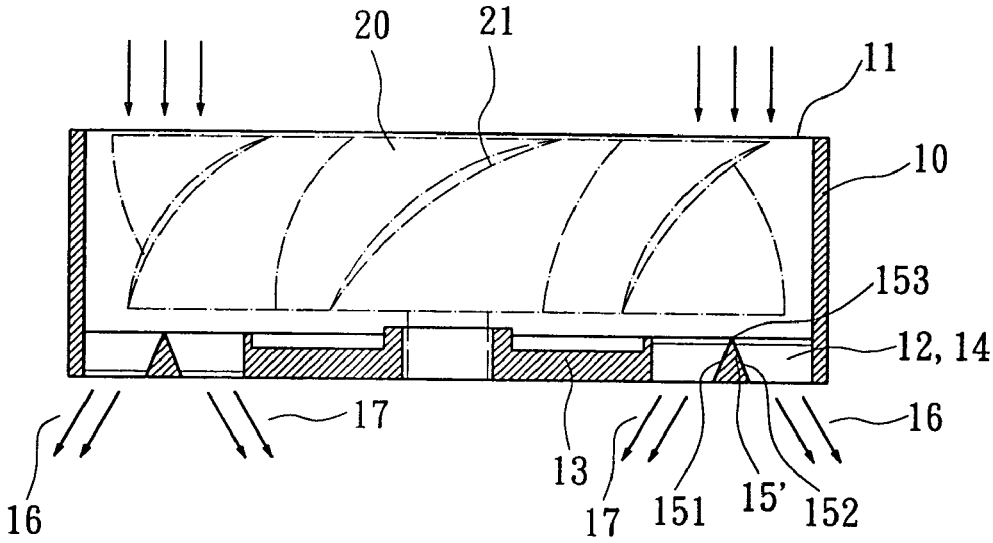
FIG. 9 is a sectional view similar to FIG. 7, illustrating a heat-dissipating fan with a fourth embodiment of the air guiding structure in accordance with the present invention.

FIG. 9 illustrates a heat-dissipating fan with a fourth embodiment of the air guiding structure in accordance with the present invention, wherein the guiding ring (now designated by 15') includes an annular inner face 151 extending downwardly (downstream) and radially inward and an annular outer face 152 extending downwardly and radially outward. Preferably, the guiding ring 15' has a triangular section, with the annular inner face 151 and the annular outer face 152 meeting at a common annular ridge 153. By this arrangement, the airflow is divided by the guiding ring 15' into an inner portion 17 that is directed toward an area directly below the base 13 and an outer portion 16 that is directed toward an area outside the air outlet 12. The heat-dissipating area is thus increased, and the heat-dissipating efficiency of an object directly below the base 13 is improved. Further, following the inclining direction for the guiding ring 15', the wind pressure is increased by the guiding ring 15', as the sectional area in the air outlet side is decreased.

Figure 10:
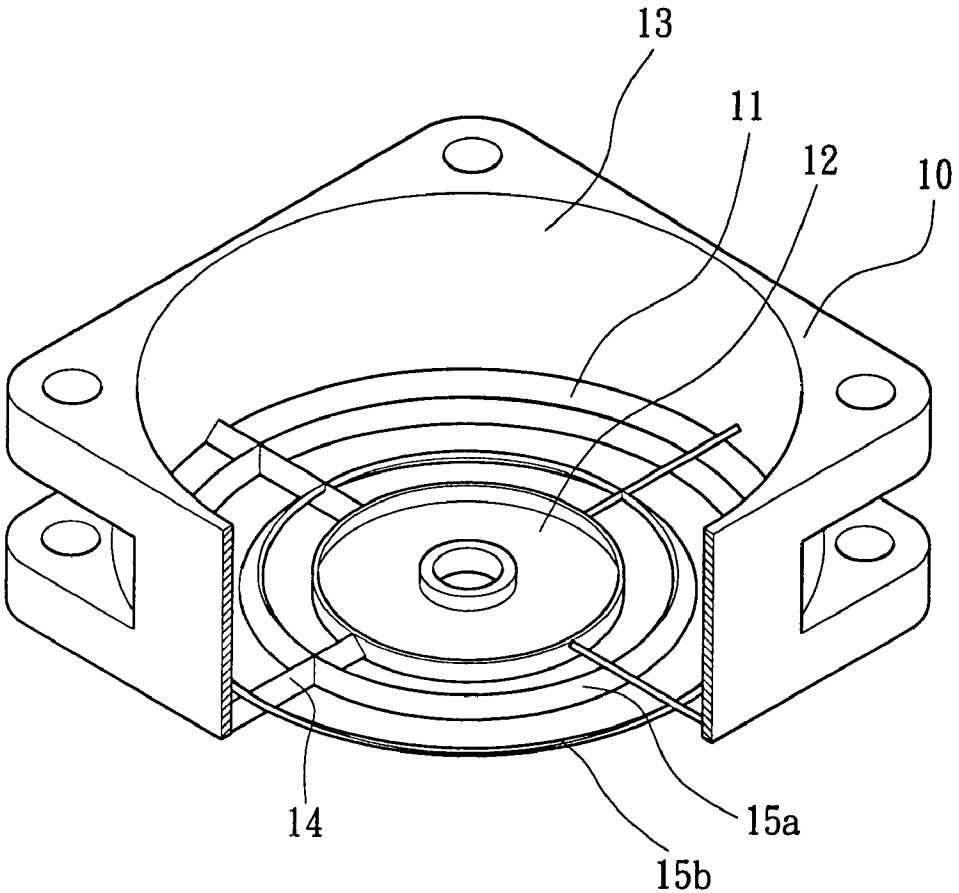
FIG. 10 is a perspective view, partly cutaway, of a heat-dissipating fan with a fifth embodiment of the air guiding structure in accordance with the present invention.
Figure 11:
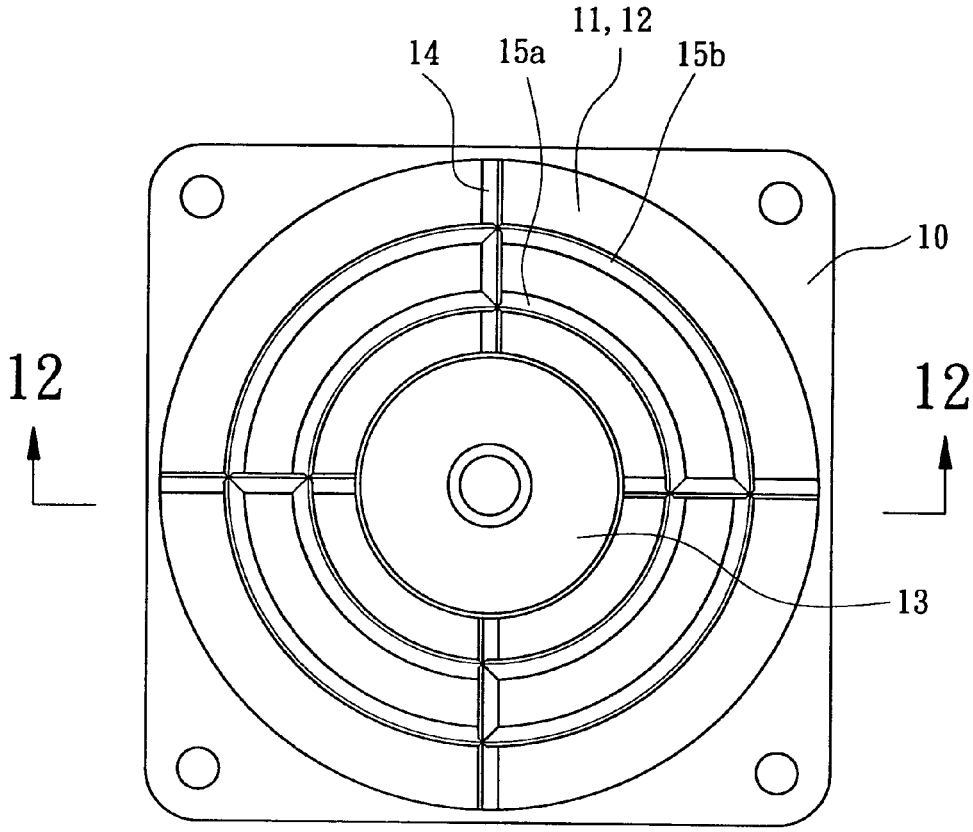
FIG. 11 is a top view of the heat-dissipating fan in FIG. 10.
Figure 12:
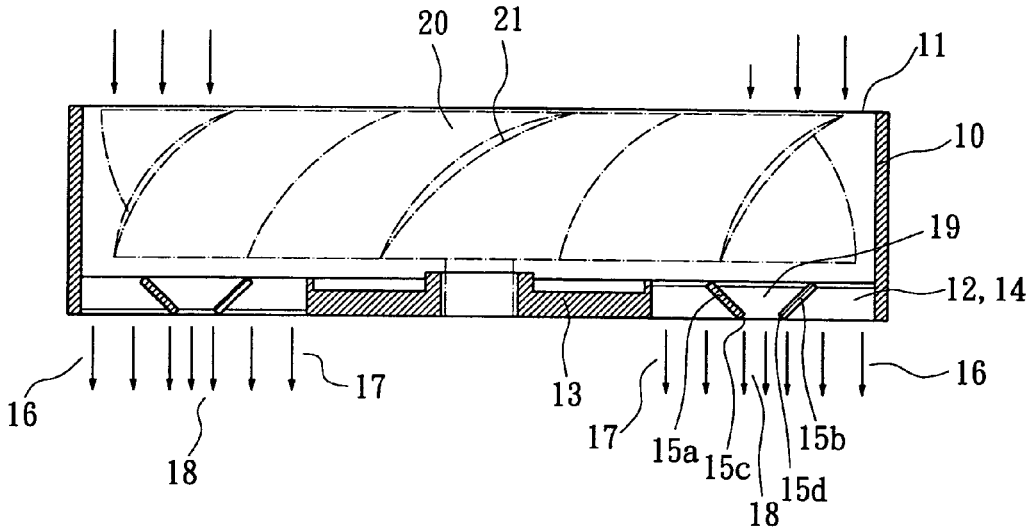
FIG. 12 is a sectional view taken along line 12—12 in FIG. 11.

FIGS. 10 through 12 illustrate a heat-dissipating fan with a fifth embodiment of the air guiding structure in accordance with the present invention, wherein an additional guiding ring is provided. In particular, a first guiding ring 15*a* and a second guiding ring 15*b* are mounted between the base 13 and the casing 10 and extend across the ribs 14. Further, the first guiding ring 15*a* is located between the base 13 and the second guiding ring 15*b*.

The first guiding ring 15*a* extends downward (downstream) and radially outward, and the second guiding ring 15*b* extends downward and radially inward, with a gap 19 being defined between a lower end 15*c* of the first guiding ring 15*a* and a lower end 15*d* of the second guiding ring 15*b*, best shown in FIG. 12.

By this arrangement, an intermediate portion 18 of the airflow is guided to an area directly below the gap 19 between first and second guiding rings 15*a* and 15*b* to concentrate the airflow and to improve the heat-dissipating effect of an object located in this area. Further, following the inclining directions of the first and second guiding rings 15*a* and 15*b*, the wind pressure is increased by the first and second guiding rings 15*a* and 15*b*. Further, since the wind pressure of the intermediate portion 18 of airflow is increased, an inner portion 17 of the airflow and an outer portion 16 of the airflow tend to flow toward the area directly below the gap 19 between the first and second guiding rings 15*a* and 15*b*, thereby dissipating heat with concentrated airflow.

Figure 13:
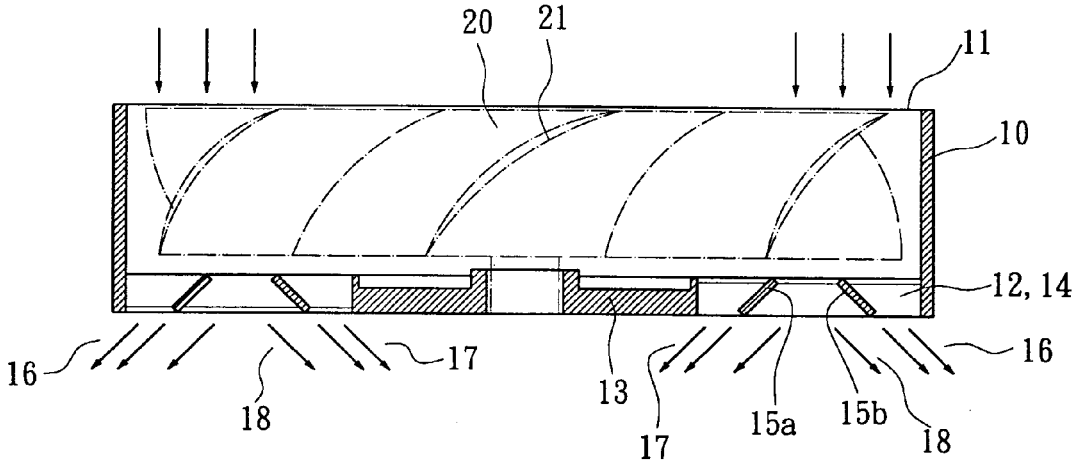
FIG. 13 is a sectional view similar to FIG. 12, illustrating a heat-dissipating fan with a sixth embodiment of the air guiding structure in accordance with the present invention.

FIG. 13 illustrates a heat-dissipating fan with a sixth embodiment of the air guiding structure in accordance with the present invention modified from the fifth embodiment. In this embodiment, the first guiding ring 15*a* extends downward (downstream) and radially inward, and the second guiding ring 15*b* extends downward and radially outward.

By this arrangement, an inner portion 17 of the airflow is directed toward an area directly below the base 13, and an outer portion 16 of the airflow is directed toward an area outside the air outlet 12. The area subjected to heat-dissipating operation is increased. This arrangement is also applicable to a limited space for reliably guiding airflow to an object not directly located below the air outlet 12 and to an object having a relatively large size for more uniform heat dissipation. Further, following the inclining directions of the first and second guiding rings 15*a* and 15*b*, the wind pressure is increased by the first and second guiding rings 15*a* and 15*b*. Further, since the wind pressures of the inner portion 17 of the airflow and the outer portion 16 of the airflow are increased, the middle portion 18 of the airflow between the first and second guiding rings 15*a* and 15*b* tend to flow toward an area directly below the base 13 and an area outside the air outlet 12, providing concentrated airflow for heat dissipation.

Figure 14:
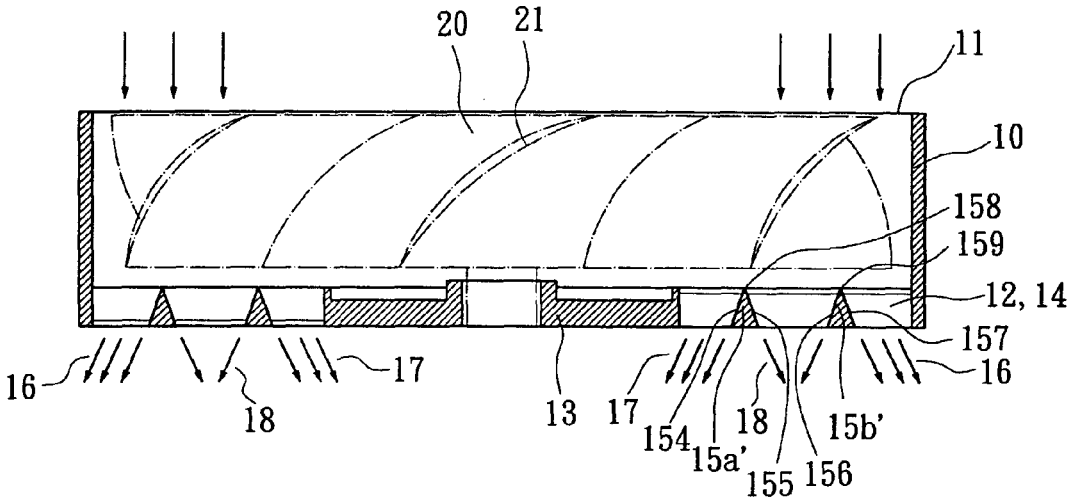
FIG. 14 is a sectional view similar to FIG. 12, illustrating a heat-dissipating fan with a seventh embodiment of the air guiding structure in accordance with the present invention.

FIG. 14 illustrates a heat-dissipating fan with a seventh embodiment of the air guiding structure in accordance with the present invention. In this embodiment, the first guiding ring (now designated by 15*a*') includes an annular inner face 154 extending downward and radially inward and an annular outer face 155 extending downward and radially outward, and the second guiding ring (now designated by 15*b*') includes an annular inner face 156 extending downward and radially inward and an annular outer face 157 extending downward and radially outward. Preferably, the first guiding ring 15*a*' has a triangular section, with the annular inner face 154 and the annular outer face 155 meeting at a common annular ridge 158. Similarly, the second guiding ring 15*b*' has a triangular section, with the annular inner face 156 and the annular outer face 157 meeting at a common annular ridge 159.

By this arrangement, the airflow is divided by the guiding rings 15*a*' and 15*b*' into an inner portion 17 that is directed toward an area directly below the base 13, an intermediate portion 18 below an area between the first and second guiding rings 15*a*' and 15*b*', and an outer portion 16 that is directed toward an area outside the air outlet 12. The heat-dissipating area is thus increased. Further, following the inclining direction of the guiding rings 15*a*' and 15*b*', the wind pressure is increased by the guiding rings 15*a*' and 15*b*', as the sectional area in the air outlet side is decreased.

Further, as illustrated in FIGS. 2 through 14, the direction of the airflow guided by means of at least one guiding ring follows from the number, the inclining direction, and the inclining angle of the guiding ring(s) in response to the size, location, and shape of the blades 21 of the impeller 20 and of the object (such as fins) to be dissipated as well as the amount of heat to be dissipated.

While the principles of this invention have been disclosed in connection with specific embodiments, it should be understood by those skilled in the art that these descriptions are not intended to limit the scope of the invention, and that any modification and variation without departing the spirit of the invention is intended to be covered by the scope of this invention defined only by the appended claims.

What is claimed is:

1. A heat-dissipating fan comprising:

a casing having an air outlet;

a base mounted in the air outlet, an impeller being adapted to be mounted on the base and having a plurality of blades;

a plurality of ribs each extending between the base and the casing along a radial direction of the base; and at least one guiding ring fixedly mounted to the ribs, said at least one guiding ring including an annular inner face extending downstream and radially inward and an annular outer face extending downstream and radially outward, said at least one guiding ring guiding and dividing airflow passing through the air outlet when the impeller is turning.

2. The heat-dissipating fan as claimed in claim 1, wherein said at least one guiding ring extends in a direction parallel to a longitudinal direction of the casing.

3. The heat-dissipating fan as claimed in claim 1, wherein said at least one guiding ring extends downstream and radially outward.

4. The heat-dissipating fan as claimed in claim 1, wherein said at least one guiding ring extends downstream and radially inward.

5. The heat-dissipating fan as claimed in claim 1, wherein said at least one guiding ring has a triangular section, with the annular inner face and the annular outer face meeting at a common annular ridge.

6. The heat-dissipating fan as claimed in claim 1, wherein said at least one guiding ring has a rounded guiding portion in a top thereof adjacent to an air inlet side of the casing.

7. A heat-dissipating fan comprising:

a casing having an air outlet;

a base mounted in the air outlet, an impeller being adapted to be mounted on the base and having a plurality of blades;

a plurality of ribs each extending between the base and the casing along a radial direction of the base;

a first guiding ring fixedly mounted to the ribs and located between the base and the casing; and a second guiding ring fixedly mounted to the ribs and located between the first guiding ring and the casing;

wherein said first guiding ring and second guiding ring extend downstream, and said first guiding ring further extends radially outward while said second guiding ring extends radially inward, or said first guiding ring further extends radially inward while said second guiding ring extends radially outward; and wherein the first guiding ring and the second guiding ring guides and divides airflow passing through the air outlet when the impeller is turning.

8. The heat-dissipating fan as claimed in claim 7, wherein each of the first guiding ring and the second guiding ring has an axial length and a width in the radial direction, with the axial length being longer than the width.

9. The heat-dissipating fan as claimed in claim 8, wherein the first guiding ring extends downstream and radially outward and wherein the second guiding ring extends downstream and radially inward.

10. The heat-dissipating fan as claimed in claim 8, wherein the first guiding ring extends downstream and radially inward and wherein the second guiding ring extends downstream and radially outward.

11. The heat-dissipating fan as claimed in claim 8, wherein the first guiding ring includes an annular inner face extending downstream and radially inward and an annular outer face extending downstream and radially outward, and wherein the second guiding ring includes an annular inner face extending downstream and radially inward and an annular outer face extending downstream and radially outward.

12. The heat-dissipating fan as claimed in claim 11, wherein each of the first guiding ring and the second guiding ring has a triangular section, with the annular inner face and the annular outer face of the first guiding ring meeting at a common annular ridge, and with the annular inner face and the annular outer face of the second guiding ring meeting at another common annular ridge.

13. The heat-dissipating fan as claimed in claim 7, wherein the first guiding ring includes an annular extending downstream and radially inward and an annular outer face extending downstream and radially outward, and wherein the second guiding ring includes an annular inner face extending downstream and radially inward and an annular outer face extending downstream and radially outward.

14. The heat-dissipating fan as claimed in claim 13, wherein each of the first guiding ring and the second guiding ring has a triangular section, with the annular inner face and the annular outer face of the first guiding ring meeting at a common annular ridge, and with the annular inner face and the annular outer face of the second guiding ring meeting at another common annular ridge.

15. The heat-dissipating fan as claimed in claim 7, wherein the ribs incline along an air-driving direction of the blades of the impeller.

16. A heat-dissipating fan comprising:

a casing having an air outlet;

a base mounted in the air outlet, an impeller being adapted to be mounted on the base and having a plurality of blades;

a plurality for ribs each extending between the base and the casing along a radial direction of the base, said ribs being inclined along an air-driving direction of the blades of the impeller, each said rib having two rib sections disposed on either side of said guiding ring, said rib sections having different inclination angles; and at least one guiding ring fixedly mounted to the ribs, said guiding ring guiding and dividing airflow passing through the air outlet when the impeller is turning.

* * * * *